United States Patent [19]

Haynie

[11] Patent Number: 4,782,533

[45] Date of Patent: Nov. 1, 1988

[54] STEREOPHONIC PILLOW SPEAKER SYSTEM

[76] Inventor: James L. Haynie, 501 N. Main, Suite 117, Fort Worth, Tex.

[21] Appl. No.: 2,297

[22] Filed: Jan. 12, 1987

[51] Int. Cl.[4] ..... H04R 5/02

[52] U.S. Cl. ..... 381/24; 381/188; 381/205

[58] Field of Search ..... 381/188, 205, 24

[56] References Cited

U.S. PATENT DOCUMENTS

| | | | |
|---|---|---|---|
| 2,908,766 | 10/1959 | Taylor | 179/82 |
| 3,290,450 | 12/1966 | Majoros | 179/146 |
| 3,384,719 | 5/1968 | Lanzara | 179/146 |
| 3,452,836 | 7/1969 | Carsello et al. | 181/31 |
| 3,792,754 | 2/1974 | Hanson | 181/31 B |
| 4,027,112 | 5/1977 | Heppner et al. | 179/146 H |
| 4,038,499 | 7/1977 | Yeaple | 179/146 H |

FOREIGN PATENT DOCUMENTS

| | | | |
|---|---|---|---|
| 293911 | 7/1928 | United Kingdom | 381/188 |

*Primary Examiner*—Forester W. Isen

*Attorney, Agent, or Firm*—James E. Bradley

[57] ABSTRACT

A stereophonic pillow speaker system for a pillow. The system has a rectangular foam base member. A pair of stereophonic loudspeakers are mounted within holes in the base member. An inner cushion wrapping is wrapped around the base member, and an outer cushion wrapping is wrapped around the inner cushion wrapping. An electric wire extends from the loudspeakers out of the pillow through one corner of the pillow. A foam securing member secures the wire to the corner of the pillow. A jack on the end of the wire can be plugged into a sound source, such as a tape player.

2 Claims, 1 Drawing Sheet

STEREOPHONIC PILLOW SPEAKER SYSTEM

BACKGROUND OF THE INVENTION

1. Field of the Invention

This invention relates in general to pillows and to stereophonic speaker systems. In particular, the invention relates to stereophonic speaker systems, designed to be contained within a pillow.

2. Description of the Prior Art

Since the invention of stereophonic sound reproduction, there have been many attempts to design a headrest or a pillow containing a stereophonic speaker system. U.S. Pat. No. 4,027,112, issued to Heppner et al. on May 31, 1977, shows one such headrest and speaker system combination. That patent shows a foam headrest, which provides a housing and support for a pair of speakers. The headrest is covered by an airtight upholstering material, except for a perforated area directly in front of each speaker.

U.S. Pat. No. 3,290,450, issued to Majoros on Dec. 6, 1966, shows a stereophonic speaker system mounted in a pillow. The system is mounted in a foam pillow, which is comprised of two foam sections which are sealed along their mating surfaces.

SUMMARY OF THE INVENTION

The stereophonic pillow speaker system of the invention is designed for a pillow having four corners. The system has a rectangular foam base member, with a pair of stereophonic loudspeakers, mounted within holes in the base member.

An inner cushion wrapping is wrapped around the base member and the loudspeakers. An outer cushion wrapping is then wrapped around the inner cushion wrapping, and fastened together.

An electric wire extends from the loudspeakers to one corner of the pillow. A foam securing member is attached to the foam base member to secure the wire to the corner of the pillow. A jack is attached to the end of the wire, so that the wire can be plugged into a tape player or other sound transmitter.

DESCRIPTION OF THE PREFERRED EMBODIMENT

Figure 1:
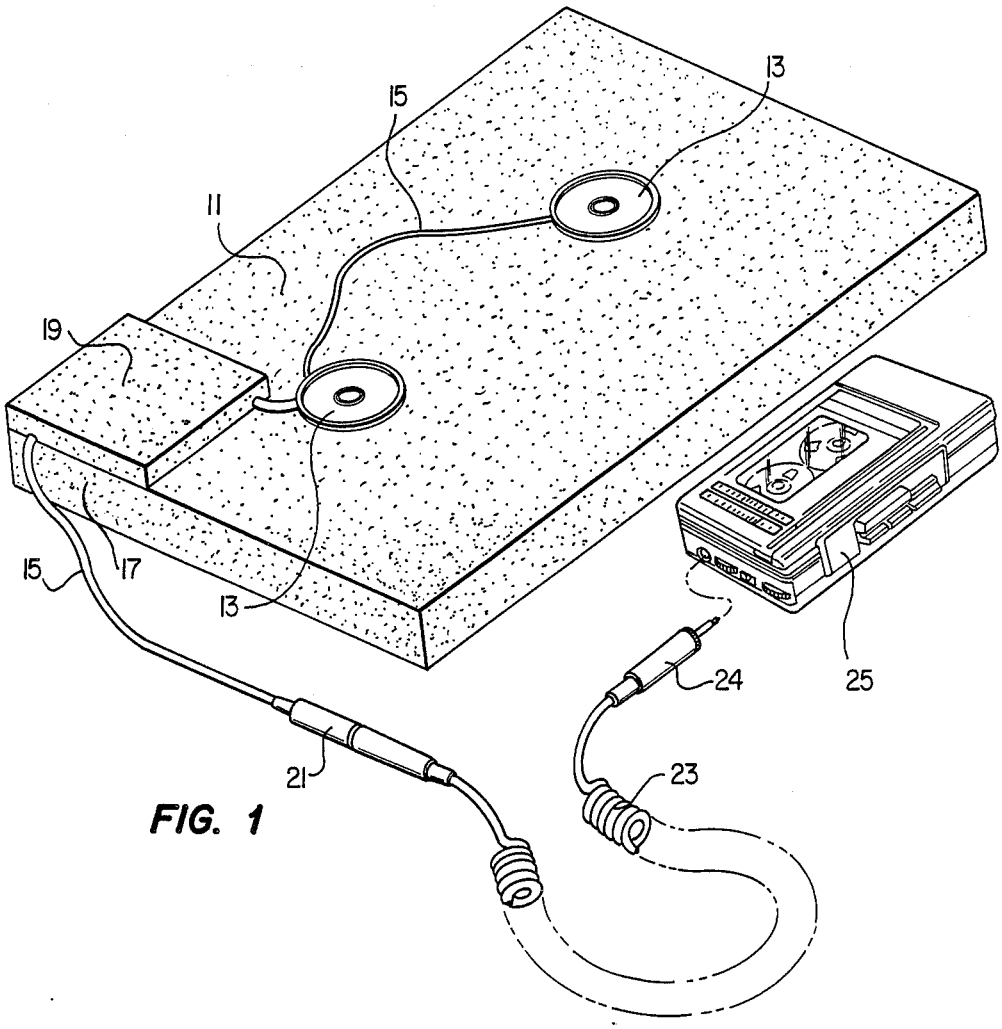
FIG. 1 is a perspective view of the pillow speaker system, with the wrappings removed.

The stereophonic pillow speaker system of the invention has a rectangular, foam base member 11, as shown in FIG. 1. The base member 11 is preferably a polyurethane foam material. The preferred base member 11 is about thirteen inches wide, twenty inches long, and one and one half inches thick.

A pair of stereophonic loudspeakers 13 are mounted in holes in the foam base member 11. Both loudspeakers 13 face upward. Each loudspeaker 13 has an axis that is parallel with the other. The upper edges of the loudspeakers 13 are flush with the upper surface of the base member 11. The holes for the loudspeakers 13 are preferably about ten inches apart.

The loudspeakers 13 are connected by an electric wire 15. The electric wire 15 then extends from one of the loudspeakers 13 to one corner 17 of the base member 11. The electric wire 15 overlies the upper surface of the base member 11.

A foam securing member 19 is attached to the upper surface of the base member 11 by an adhesive, to secure the electric wire 15 to the corner 17 of the base member 11. The foam securing member 19 overlies the electric wire 15 near one edge of the base member 11. The foam securing member 19 is approximately four inches square and one quarter inch thick. Preferably, the securing member 19 is made of the same material as the base member 11.

A standard electrical connection, or jack 21, is attached to the outer end of the electric wire 15. This jack 21 can be plugged into a standard extension 23. The extension 23 also has a jack 24, which can be plugged into a tape player 25, radio, television, or other sound source.

Figure 2:
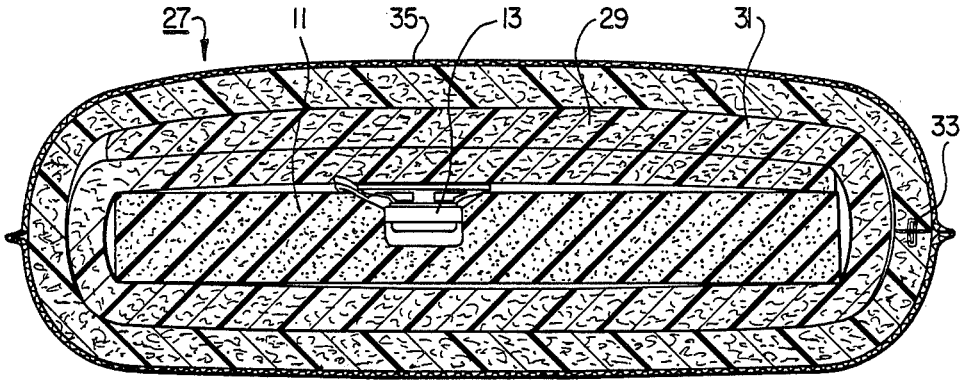
FIG. 2 is a sectional view through the pillow speaker system of the invention.

FIG. 2 illustrates the assembled pillow 27. The foam base member 11 and the loud speakers 13 are wrapped in an inner cushion wrapping 29. The inner cushion wrapping 29 overlies and is in contact with the upper edges of the loudspeakers 13. An outer cushion wrapping 31 is wrapped around the inner cushion wrapping 29.

The cushion wrappings 29, 31 are not made of the same material as the foam base member 11. They are preferably made of Dacron synthetic fiber, which is a synthetic polyester material. This type of material is commonly used in conventional pillows.

The cushion wrappings 29, 31 are considerably lighter in density than the material of the base member 11. Also, the cushion wrapping material is fibrous, rather than cellular as is the material of the base member 11. Although the foam base member 11 is flexible, the cushion wrappings 29, 31 are softer and more comfortable. The inner and outer cushion wrappings 29, 31 are of the same thickness, which is less than half the thickness of the base member 11.

The outer cushion wrapping 31 is held together by a fastener 33. The outer cushion wrapping 31 does not overlap itself, and its edges abut one another at one edge of the pillow. The inner cushion wrapping 29 does overlap itself for the extent of the width of the base member 11. The edges of the inner cushion wrapping 29 do not abut, and are not secured together. The assembled pillow 27 is placed within a conventional pillow case 35.

The operation of the stereophonic pillow speaker system of the invention is very simple. The jack 24 on the end of the extension cord 23 is plugged into a tape player 25 or some other electrical sound source. When the tape player 25 is played, the sound emits from the loudspeakers 13, so that a person resting on the pillow 27 can hear the sound.

The invention has several advantages. Only the person resting on the pillow 27 can hear the sound coming from the loudspeakers 13. Others in the room will not be disturbed. However, unlike earphones, the pillow 27 does not prevent the listener from hearing other sounds in the room, such as a telephone or a doorbell. The foam base member provides a strong support for the loudspeakers, with the cushion wrappings providing comfort. The two layers of the cushion wrappings prevent the user from feeling contact with the loudspeakers.

The invention has been shown in only one of its forms. It should be apparent to those skilled in the art that it is not so limited, but is susceptible to various changes without departing from the scope thereof.

I claim:

1. A stereophonic pillow speaker system, for a pillow having corners, the speaker system comprising:

a rectangular cellular foam base member;

a pair of stereophonic loudspeakers, mounted within holes in the base member, each loudspeaker having an axis spaced apart from and substantially parallel with the other, each loudspeaker having an upper edge flush with the upper side of the base member and located substantially in the same plane as the other loudspeaker;

an inner cushion wrapping of a fibrous material, wrapped entirely around the base member and the loudspeakers, the cushion wrapping having an inner surface that overlies and contacts the upper edges of the loudspeakers;

an outer cushion wrapping of fibrous material wrapped around the inner cushion wrapping;

an electric wire, extending from the loudspeakers between the cushion material and the base material and out of the pillow; and a jack, attached to the outer end of the electric wire for connection to a sound source.

2. A stereophonic pillow speaker system, for a pillow having corners, the speaker system comprising:

a rectangular cellular foam base member;

a pair of stereophonic loudspeakers, mounted within holes in the base member, each loudspeaker having an upper edge flush with the upper side of the base member and located substantially in the same plane as the other loudspeaker;

a inner cushion wrapping of a fibrous material, wrapped entirely around the base member and the loudspeakers, the inner cushion wrapping having an inner surface that overlies and contacts the upper edges of the loudspeakers, the inner cushion wrapping having edges that overlap one another;

an outer cushion wrapping of fibrous material wrapped around the inner cushion wrapping, the outer cushion wrapping having edges which abut one another and are secured by a fastener;

an electric wire, extending from the loudspeakers between the cushion material and the base material and out of the pillow;

a foam securing member secured by an adhesive to the upper surface of the base member adjacent one edge of the base member and overlying the electric wire to secure the electric wire to the base member; and a jack, attached to the outer end of the electric wire for connection to a sound source.

* * * * *